US010494209B2

(12) United States Patent
Koga et al.

(10) Patent No.: US 10,494,209 B2
(45) Date of Patent: Dec. 3, 2019

(54) SHEET PROCESSING APPARATUS

(71) Applicant: GLORY LTD., Hyogo (JP)

(72) Inventors: Fumiaki Koga, Hyogo (JP); Takashi Kaneshiro, Hyogo (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 15/835,890

(22) Filed: Dec. 8, 2017

(65) Prior Publication Data

US 2018/0162662 A1 Jun. 14, 2018

(30) Foreign Application Priority Data

Dec. 13, 2016 (JP) ..... 2016-241352

(51) Int. Cl.
*B65H 3/52* (2006.01)

(52) U.S. Cl.
CPC ..... *B65H 3/5261* (2013.01); *B65H 3/523* (2013.01); *B65H 3/5284* (2013.01); *B65H 2402/54* (2013.01); *B65H 2403/51* (2013.01); *B65H 2404/144* (2013.01); *B65H 2404/1441* (2013.01); *B65H 2404/1521* (2013.01); *B65H 2701/1912* (2013.01)

(58) Field of Classification Search
CPC ..... B65H 3/5261; B65H 2404/1521; B65H 2404/144; B65H 2404/1441
See application file for complete search history.

(56) References Cited

U.S. PATENT DOCUMENTS 4,611,939 A 9/1986 Fujiwara
6,494,451 B2 * 12/2002 Michel ..... B65H 5/062 101/DIG. 35
7,334,788 B2 * 2/2008 Sakamaki ..... B65H 3/5261 271/122
7,523,933 B2 * 4/2009 Linder ..... B65H 5/062 271/274
7,793,935 B2 * 9/2010 Wang ..... B65H 5/062 271/272
9,004,481 B2 * 4/2015 Mimura ..... B65H 29/14 270/58.11
2005/0184455 A1 * 8/2005 Youn ..... B65H 5/06 271/274
2007/0069456 A1 * 3/2007 Jeong ..... B65H 5/062 271/272
2016/0103634 A1 * 4/2016 Van Acquoij ..... B41J 29/38 347/16

FOREIGN PATENT DOCUMENTS

CN 100999292 A 7/2007
JP S58-224929 A 12/1983
JP 07-033276 A 2/1995
WO 2014/063470 A1 5/2014

OTHER PUBLICATIONS

Extended European Search Report for 17204472.9 dated May 16, 2018.

* cited by examiner

*Primary Examiner* — Jeremy R Severson
(74) *Attorney, Agent, or Firm* — Brundidge & Stanger, P.C.

(57) ABSTRACT

A paper sheet feeding unit includes: a plurality of feed rollers; a plurality of gate rollers respectively disposed opposite to the plurality of feed rollers in a one-to-one relationship; a biasing member that biases the plurality of gate rollers individually in a direction of the plurality of feed rollers; and a supporting member that supports the plurality of gate rollers and the biasing member.

5 Claims, 11 Drawing Sheets

SHEET PROCESSING APPARATUS

CROSS REFERENCE TO RELATED APPLICATIONS

The disclosure of Japanese Patent Application No. 2016-241352 filed on Dec. 13, 2016, including the specification, drawings and abstract is incorporated herein by reference in its entirety.

TECHNICAL FIELD

The present invention relates to a paper sheet feeding unit.

BACKGROUND ART

PTL 1 discloses a paper-sheet feeding automatic adjustment mechanism that enables high-speed and stable feeding of paper sheets. This paper-sheet feeding automatic adjustment mechanism includes an opposing state adjusting means for adjusting the opposing state of the feed roller and the gate roller. The paper-sheet feeding automatic adjustment mechanism disclosed in PTL 1 is of a so-called gap type, in which a gap is provided between the gate roller and the feed roller.

CITATION LIST

Patent Literature

PTL 1
Japanese Patent Application Laid-Open No. 7-33276

SUMMARY OF INVENTION

Technical Problem

Meanwhile, paper sheet feeding units of a pressure contact type are known. In the pressure contact type, a plurality of gate rollers are in contact with a plurality of opposing feed rollers with a predetermined pressure.

In the conventional pressure contact type, the plurality of gate rollers are provided to a single shaft, and rotate around the single shaft. Accordingly, the plurality of gate rollers are brought into pressure contact with the plurality of opposing feed rollers with an equal force.

Disadvantageously, when a paper sheet whose coefficient of friction against the feed roller varies depending on the portion, such as a banknote whose thickness partially varies and a banknote having uniform thickness whose coefficient of friction partially varies, passes between the plurality of gate rollers and the plurality of feed rollers which are brought into pressure contact with each other with such an equal force, skewing of the paper sheet results.

When, for example, a thick portion of a paper sheet passes between a feed roller and a gate roller, and a thin portion of the paper sheet passes between another feed roller and another gate roller, the force exerted from the gate roller on the thick portion of the paper sheet is greater than the thin portion since the conventional gate rollers are provided around a single shaft and are in pressure contact with the feed rollers (or, are biased in a direction of the feed rollers) with an equal force as described above. The coefficient of frictional is increased at the thick portion, on which the larger force is exerted, than the thin portion in the paper sheet, and thus the advancement speed of the thick portion is reduced in comparison with the thin portion. This results in skewing of the paper sheet.

In view of this, an object of the present invention is to provide a paper sheet feeding unit that suppresses skewing of paper sheets.

Solution to Problem

A paper sheet feeding unit of an embodiment of the present invention includes: a plurality of feed rollers; a plurality of gate rollers respectively disposed opposite to the plurality of feed rollers; a biasing member that independently biases the plurality of gate rollers toward the plurality of feed rollers; and a supporting member that supports the plurality of gate rollers and the biasing member.

Advantageous Effects of Invention

According to the present invention, skewing of paper sheets can be suppressed.

DESCRIPTION OF EMBODIMENTS

Embodiments of the present invention are described below with reference to the accompanying drawings.

First Embodiment

Figure 1:
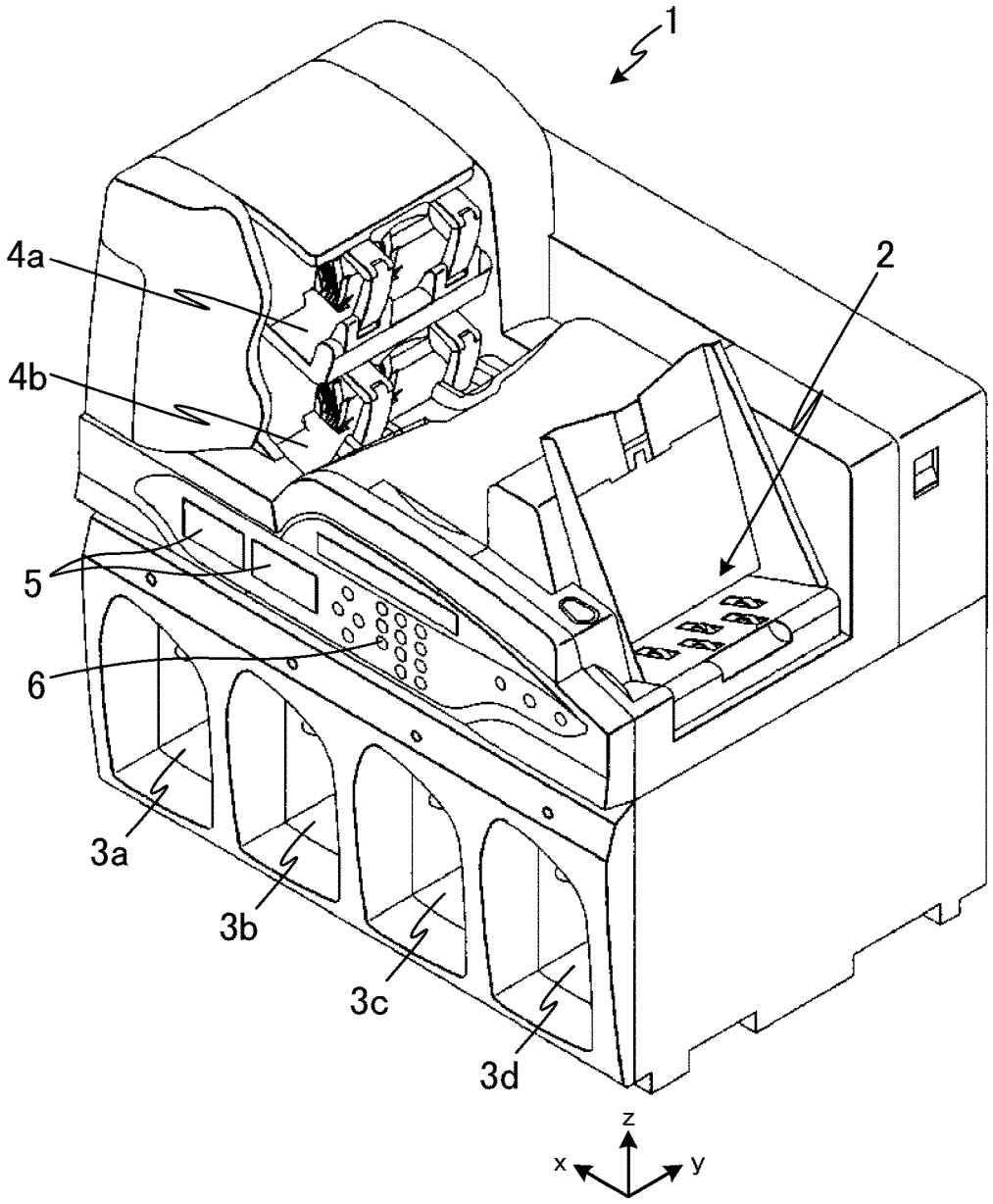
FIG. 1 is a perspective view of a paper sheet processing device in which a paper sheet feeding unit according to a first embodiment of the present invention is applied.

FIG. 1 is a perspective view of a paper sheet processing device 1 in which a paper sheet feeding unit according to the first embodiment of the present invention is applied. As illustrated in FIG. 1, the paper sheet processing device 1 includes a placing part 2, storing parts 3*a* to 3*d*, storing parts 4*a* and 4*b*, a display part 5, and an operation part 6. The following description will be made with the axis orthogonal coordinate system of x, y, and z illustrated in FIG. 1 with respect to the paper sheet processing device 1.

Paper sheets are placed on the placing part 2. The paper sheets placed on the placing part 2 are taken in into the apparatus one by one in response to a predetermined operation of the user on the operation part 6, for example.

The paper sheet which has been taken in into the apparatus is stored in any one of storing parts 3*a*, 3*b*, 3*c*, 3*d*, 4*a*, and 4*d*. Examples of the paper sheet include a banknote, a ballot paper and the like. In the following description, the paper sheet is a banknote.

The storing parts 3*a* to 3*d* respectively store banknotes of predetermined denominations. The denominations of the banknotes which have been taken in into the apparatus are determined by an identification part described later, and the banknotes are stored (sorted) into the storing parts 3*a* to 3*d* in accordance with the denominations, for example.

The storing parts 4*a* and 4*b* house rejected banknotes which are not housed in the storing parts 3*a* to 3*d*. Examples of the rejected banknotes include counterfeit notes and unfit notes. It is determined whether the banknote taken in into apparatus is a rejected banknote by the identification part described later.

The display part 5 is a liquid crystal display, and displays a count result of banknotes and the like, for example. The operation part 6 is a key apparatus, and receives a predetermined operation from the user, for example. For example, the operation part 6 receives, from the user, a request for sorting banknotes, and a request for starting count.

Figure 2:
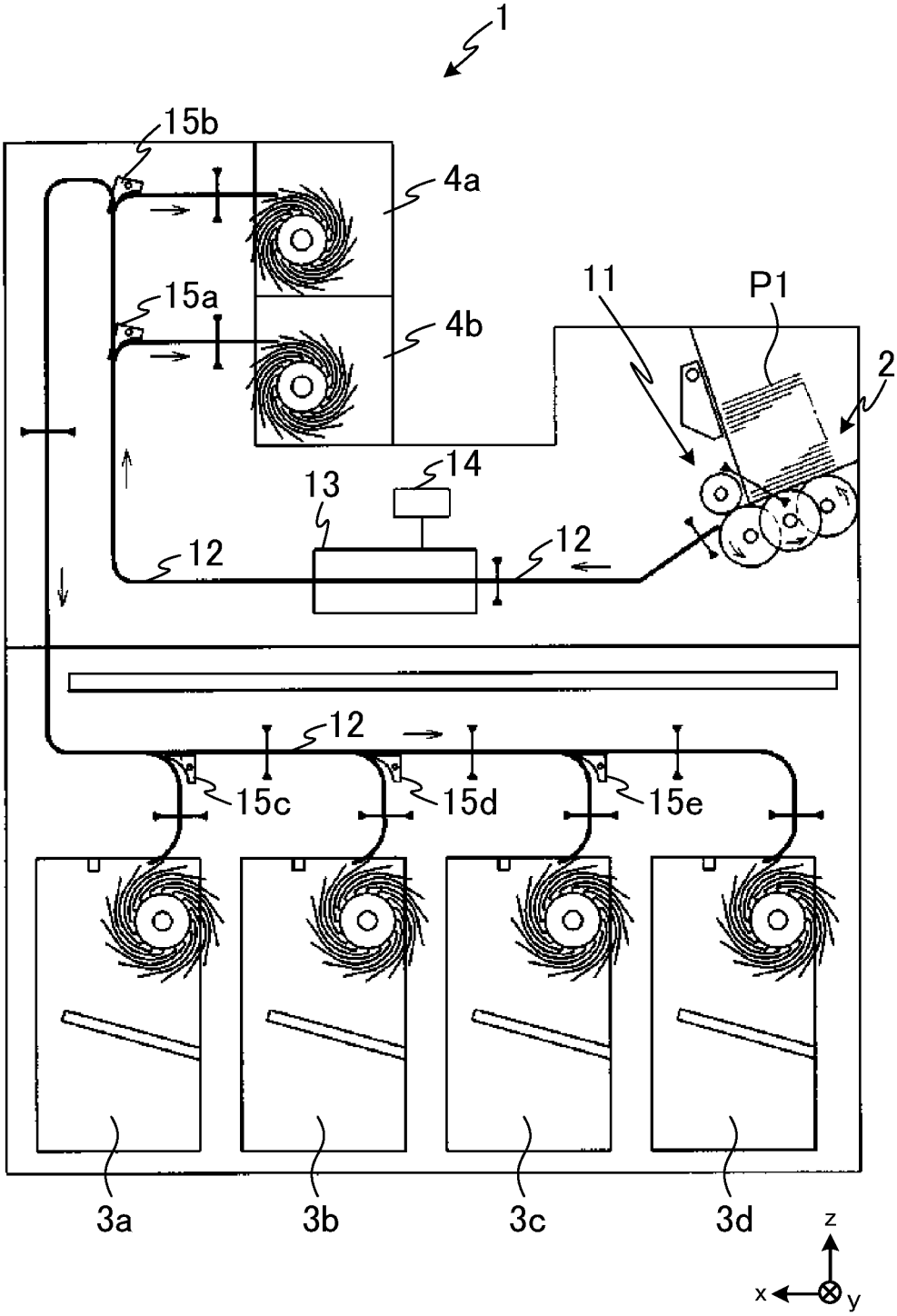
FIG. 2 is a schematic sectional view taken along the xz-plane of the paper sheet processing device illustrated in FIG. 1.

FIG. 2 is a schematic sectional view taken along the xz-plane of the paper sheet processing device 1 of FIG. 1. In FIG. 2, the components same as those of FIG. 1 are denoted with the same reference numerals. As illustrated in FIG. 2, the paper sheet processing device 1 includes a paper sheet feeding unit 11, a conveyance part 12, an identification part 13, a control part 14, and branches 15*a* to 15*e*.

The paper sheet feeding unit 11 feeds a banknote P1 placed on the placing part 2 to the conveyance part 12 one by one. The conveyance part 12 conveys the banknote fed from the paper sheet feeding unit 11 to any one of the storing parts 3*a*, 3*b*, 3*c*, 3*d*, 4*a*, and 4*d*.

An identification part 13 is provided in a region around the conveyance part 12 on the downstream side of the paper sheet feeding unit 11 (in the direction in which the banknote is conveyed) and on the upstream side of the storing parts 3*a*, 3*b*, 3*c*, 3*d*, 4*a*, and 4*d*. The identification part 13 includes a magnetic sensor, a line sensor, an ultraviolet sensor and the like (not illustrated), and identifies the denomination, discrimination, authentication, fitness and the like of the banknote based on the sensor value, for example.

A control part 14 controls the branches 15*a* to 15*e* in accordance with the identification result of the identification part 13. The branches 15*a* to 15*e* separate the banknotes conveyed by the conveyance part 12 in accordance with the control of the control part 14 into the storing parts 3*a*, 3*b*, 3*c*, 3*d*, 4*a*, and 4*d*. For example, the control part 14 controls the branches 15*a* to 15*e* such that the banknotes of predetermined denominations identified by the identification part 13 are stored in the storing parts 3*a* to 3*d* in accordance with identification result.

Figure 3:
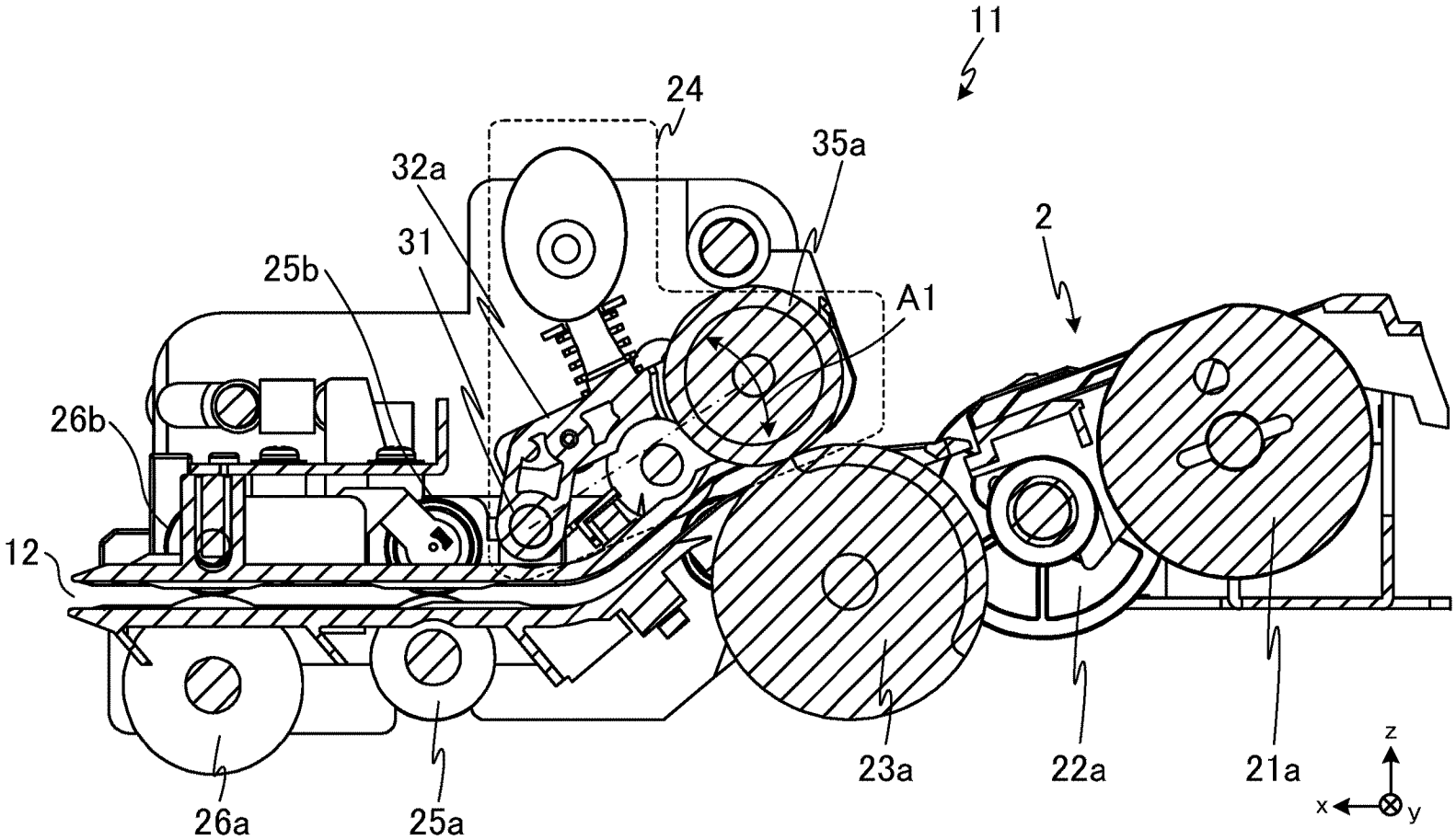
FIG. 3 illustrates details of the paper sheet feeding unit illustrated in FIG. 2.

FIG. 3 illustrates details of the paper sheet feeding unit 11 of FIG. 2. In FIG. 3, the components same as those of FIG. 2 are denoted with the same reference numerals. As illustrated in FIG. 3, the paper sheet feeding unit 11 includes an auxiliary conveyance roller 21*a*, a kicker roller 22*a*, a feed roller 23*a*, a gate roller part 24 (the portion indicated with the dotted line), conveyance rollers 25*a* and 26*a*, and counter rollers 25*b* and 26*b*.

The auxiliary conveyance roller 21*a* rotates counterclockwise in the drawing. The auxiliary conveyance roller 21*a* assists kicking of banknotes of the kicker roller 22*a*, and is referred to also as an auxiliary kicker roller.

The kicker roller 22*a* is provided on the downstream side of the auxiliary conveyance roller 21*a*. The kicker roller 22*a* rotates counterclockwise in the drawing. The kicker roller 22*a* kicks, toward the downstream side, the lowermost banknotes of a plurality of banknotes placed on the placing part 2.

The feed roller 23*a* is provided on the downstream side of the kicker roller 22*a*. The feed roller 23*a* rotates counterclockwise in the drawing, and sends, to the conveyance part 12, the lowermost banknotes kicked by the kicker roller 22*a*.

The gate roller part 24 is provided on the downstream side of the kicker roller 22*a*. As specifically described later, the gate roller part 24 includes an arm shaft 31, a support arm 32*a*, and a gate roller 35*a*. One end of the support arm 32*a* is pivotally supported by the arm shaft 31, and the other end thereof supports the gate roller 35*a* such that the gate roller 35*a* can rotate.

The gate roller 35*a* is provided such that the outer peripheral surface thereof makes contact with the outer peripheral surface of the feed roller 23*a*. The gate roller 35*a* includes a one-way clutch (not illustrated), and is rotatable only in the counterclockwise direction in the drawing, for example. With this configuration, the banknote that passes between the feed roller 23*a* and the gate roller 35*a* is sent to the conveyance part 12 one by one.

The support arm 32*a* can rotate around the arm shaft 31. With this configuration, the center of the gate roller 35*a* supported by the support arm 32*a* can move along the circumference of a circle around the arm shaft 31 as two-headed arrow A1 indicates in FIG. 3.

The conveyance roller 25*a* and the counter roller 25*b* are provided to face each other on the downstream side of the feed roller 23*a* and the gate roller part 24. The conveyance roller 26*a* and the counter roller 26*b* are provided to face each other on the downstream side of the conveyance roller 25*a* and the counter roller 25*b*. The conveyance rollers 25*a* and 26*a* rotate counterclockwise in the drawing, and sends, to the conveyance part 12, the banknote sent from the feed roller 23*a*.

Figure 4:
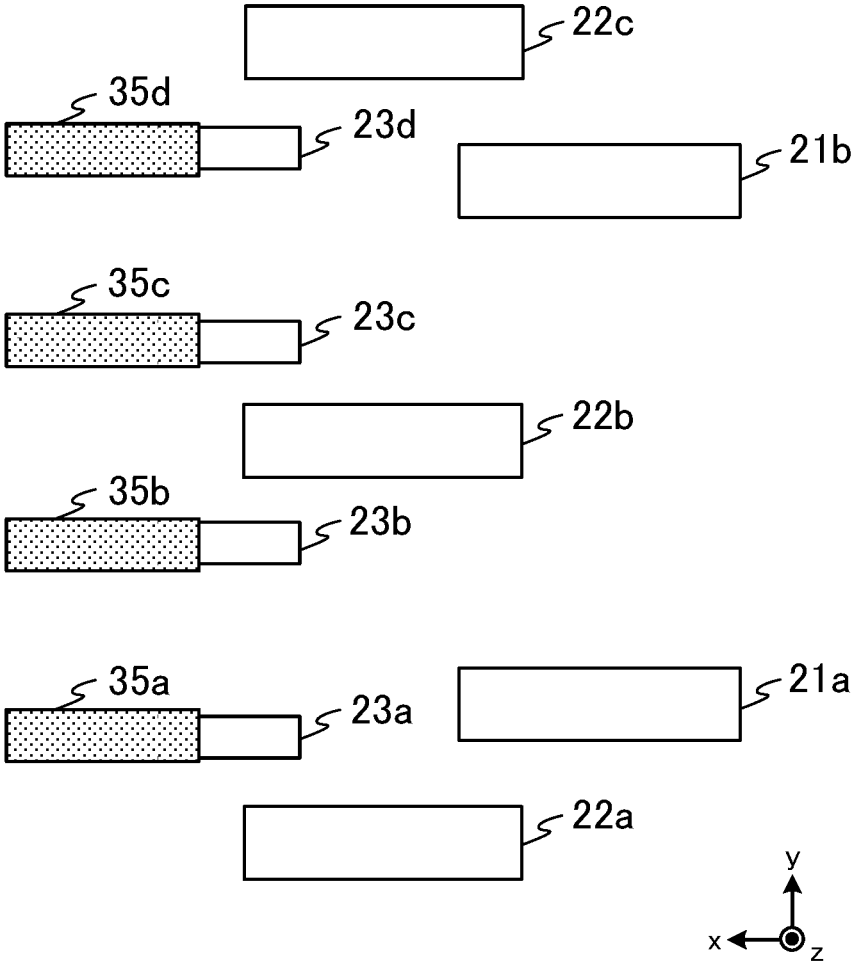
FIG. 4 illustrates a positional relationship of rollers in the paper sheet feeding unit illustrated in FIG. 3 as viewed in the +z-axis direction.

FIG. 4 illustrates a positional relationship of the rollers of the paper sheet feeding unit 11 of FIG. 3 as viewed in +z-axis direction. In FIG. 4, the components same as those of FIG. 3 are denoted with the same reference numerals. As illustrated in FIG. 4, the paper sheet feeding unit 11 includes two auxiliary conveyance rollers 21*a* and 21*b*, three kicker rollers 22*a* to 22*c*, four feed rollers 23*a* to 23*d*, and four gate rollers 35*a* to 35*d*. The banknote placed on the placing part 2 is sent out in +x-axis direction illustrated in FIG. 4.

The auxiliary conveyance rollers 21*a* and 21*b* are disposed parallel to each other along the y-axis direction. The kicker rollers 22*a* to 22*c* are disposed parallel to each other along the y-axis direction on the downstream side of the auxiliary conveyance rollers 21*a* and 21*b* (in the +x-axis direction). The feed rollers 23*a* to 23*d* are disposed parallel to each other along the y-axis direction on the downstream side of the kicker rollers 22*a* to 22*c* (in the +x-axis direction). The gate rollers 35*a* to 35*d* are disposed parallel to each other along the y-axis direction on the downstream side of the kicker rollers 22*a* to 22*c* (in the +x-axis direction). The gate rollers 35*a* to 35*d* are disposed opposite to the feed rollers 23*a* to 23*d*, respectively.

Figure 5:
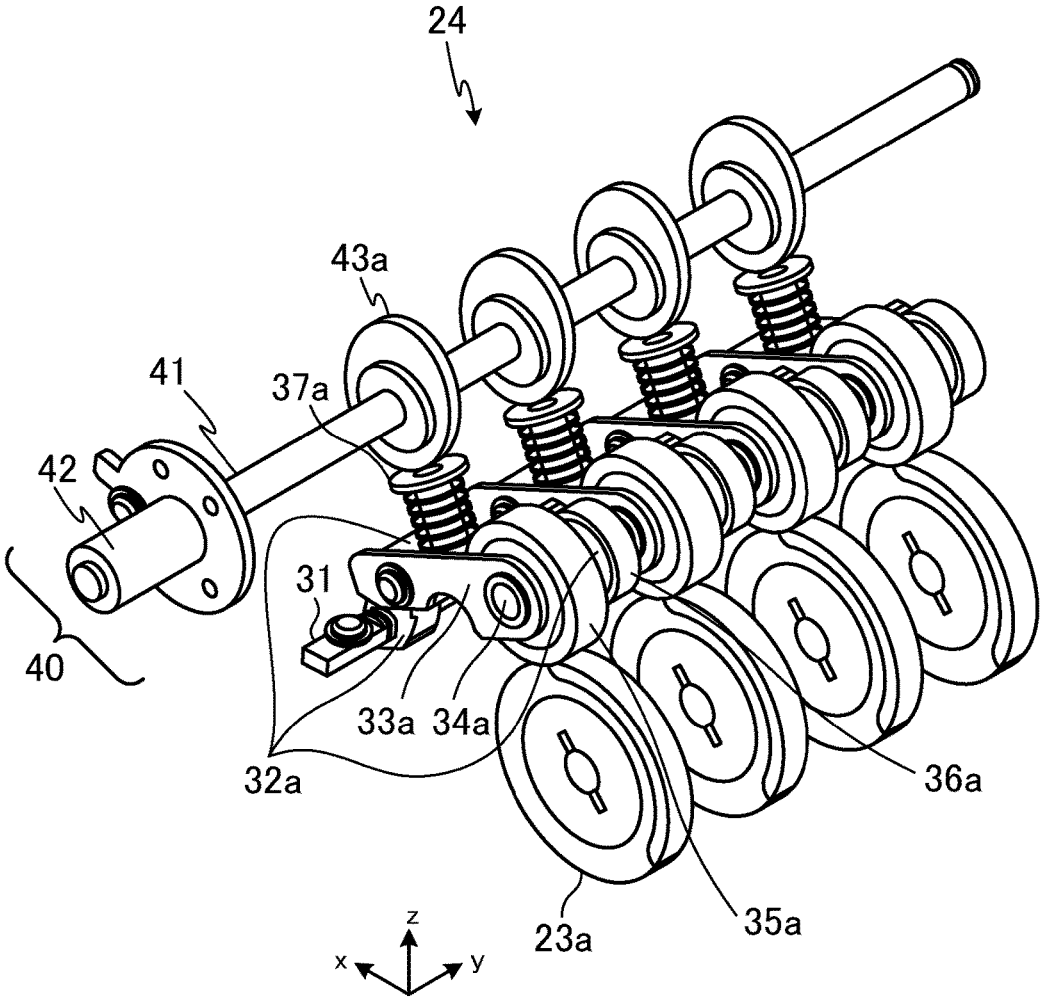
FIG. 5 is a perspective view of a gate roller part illustrated in FIG. 3.

FIG. 5 is a perspective view of the gate roller part 24 of FIG. 3. In FIG. 5, the components same as those of FIG. 3 are denoted with the same reference numerals. A part of the gate roller part 24 is described with FIG. 5, and the entirety of the gate roller part 24 is described with FIG. 7.

As illustrated in FIG. 5, the gate roller part 24 includes the arm shaft 31, the support arm 32*a*, a guide plate 33*a*, a gate roller shaft 34*a*, the gate roller 35*a*, a shaft attaching member 36*a*, a biasing member 37*a*, and an adjusting part 40.

The arm shaft 31 is a rod-shaped member. The arm shaft 31 is provided on the downstream side of the feed roller 23*a* and the gate roller 35*a*. The rod-shaped arm shaft 31 is provided such that the longitudinal direction thereof is parallel to the y axis.

One end of the support arm 32*a* is rotatably and pivotally supported by the rod-shaped arm shaft 31. The support arm 32*a* extends slightly upward (+z-axis direction) from the arm shaft 31, and extends to the upstream side (−x-axis direction) (see FIG. 6).

The guide plate 33*a* is a plate-shaped member. The guide plate 33*a* is fixed to the support arm 32*a* in a region around the arm shaft 31, and extends to the upstream side (−x-axis direction) in parallel with the support arm 32*a*.

One end of the gate roller shaft 34*a* extending along the y-axis direction is fixed at an end portion of the guide plate 33*a* on the upstream side (−x-axis direction side). The gate roller shaft 34*a* extends through the gate roller 35*a* and the support arm 32*a*, and the other end thereof is fixed to a shaft attaching member 36*a* (see FIG. 6 and FIG. 7).

The gate roller 35*a* is sandwiched between the support arm 32*a* and the guide plate 33*a*, and is rotatably attached to the gate roller shaft 34*a*.

The shaft attaching member 36*a* has a discoid shape, and fixes the other end of the gate roller shaft 34*a*, for example.

Figure 6:
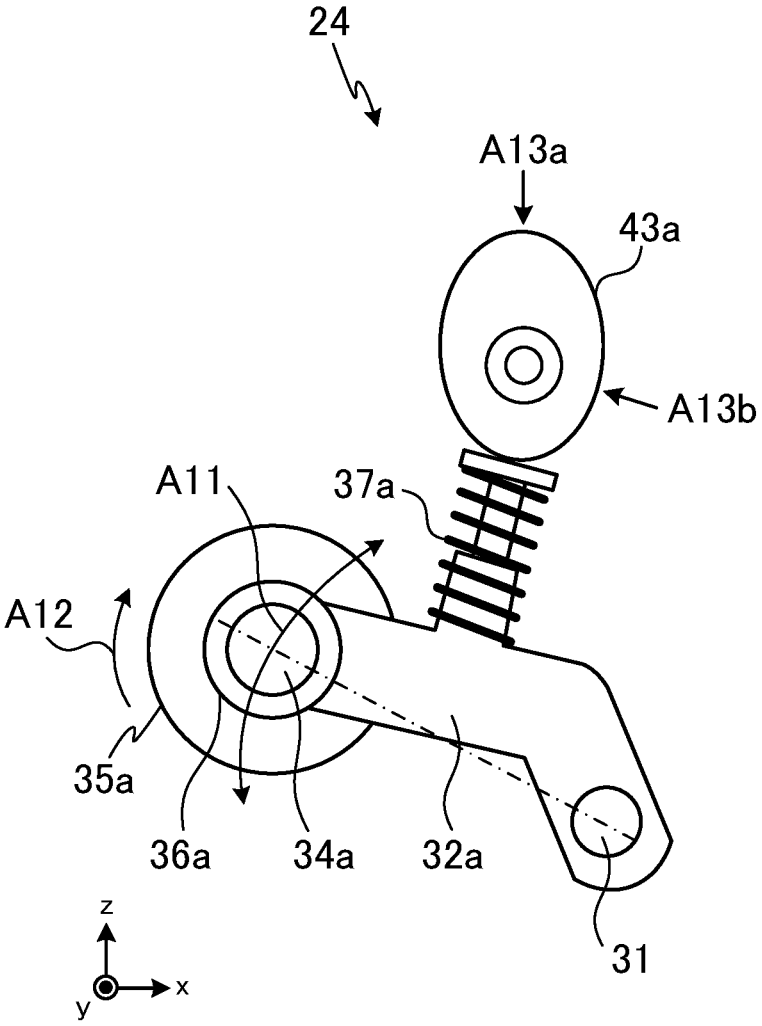
FIG. 6 illustrates a support arm of the gate roller part illustrated in FIG. 5 as viewed in the +y-axis direction.

FIG. 6 illustrates the support arm 32*a* of the gate roller part 24 of FIG. 5 as viewed in the +y-axis direction. In FIG. 6, the components same as those of FIG. 5 are denoted with the same reference numerals. In FIG. 6, the shape of the gate roller part 24 and the like are schematically illustrated. As illustrated in FIG. 6, the other end of the gate roller shaft 34*a* is fixed to the shaft attaching member 36*a*.

As described with FIG. 5, one end of the gate roller shaft 34*a* is fixed to the guide plate 33*a*. As illustrated in FIG. 6, the other end of the gate roller shaft 34*a* is fixed to the shaft attaching member 36*a*. The gate roller shaft 34*a* whose both ends are fixed to the guide plate 33*a* and the shaft attaching member 36*a* extends through the gate roller 35*a* and the support arm 32*a* pivotally supported by the arm shaft 31.

With this configuration, the gate roller 35*a* can move along the circumference of a circle around the arm shaft 31 as two-headed arrow A11 indicates in FIG. 6. In addition, the gate roller 35*a* can rotate around the gate roller shaft 34*a* in the direction indicated with arrow A12 in FIG. 6 with the one-way clutch described with FIG. 3, for example.

Now the description is returned to of FIG. 5. One end of a biasing member 37*a* is fixed to the support arm 32*a*, and the other end thereof is in contact with a cam 43*a* of the adjusting part 40 described later (see FIG. 6). The biasing member 37*a* has a coil spring, and biases the gate roller 35*a* coupled with the support arm 32*a* in a direction of the feed roller 23*a*.

The adjusting part 40 includes an adjusting shaft 41, an adjusting knob 42, and the cam 43*a*. The adjusting shaft 41 is a rod-shaped member. The rod-shaped adjusting shaft 41 is provided above the biasing member 37*a*. The rod-shaped adjusting shaft 41 is provided such that the longitudinal direction thereof is in parallel with the y axis.

The adjusting knob 42 is provided at one end of the adjusting shaft 41. The adjusting shaft 41 rotates along with the rotation of the adjusting knob 42.

The adjusting shaft 41 is provided with the cam 43*a*. The cam 43*a* is an elliptical plate member, for example. When the adjusting knob 42 is rotated, the adjusting shaft 41 is rotated, and, along with the rotation of the adjusting shaft 41, the cam 43*a* is rotated.

The other end of the biasing member 37*a* is in contact with the cam 43*a*. As described above, the cam 43*a* has an elliptical shape, for example. Accordingly, the biasing force of the biasing member 37*a* can be changed by rotating the adjusting knob 42. In addition, one end of the biasing member 37*a* is fixed to support the arm 32*a*, and the gate roller 35*a* is supported (pivotally supported) by the support arm 32*a*. Accordingly, the biasing force of the gate roller 35*a* with respect to the feed roller 23*a* can be changed by rotating the adjusting knob 42.

For example, when the adjusting knob 42 is rotated such that the distance between the other end of the biasing member 37*a* and the adjusting shaft 41 is increased (for example, when the adjusting knob 42 is rotated such that the portion of the cam 43*a* indicated with arrow A13*a* in FIG. 6 makes contact with the other end of the biasing member 37*a*), the coil spring of the biasing member 37*a* is compressed. In this manner, the biasing force of the gate roller 35*a* with respect to the feed roller 23*a* is increased. On the other hand, when the adjusting knob 42 is rotated such that the distance between the other end of the biasing member 37*a* and the adjusting shaft 41 is reduced (for example, when the adjusting knob 42 is rotated such that the portion of the cam 43*a* indicated with arrow A13*b* in FIG. 6 makes contact with the other end of the biasing member 37*a*), the coil spring of the biasing member 37*a* is stretched. In this manner, the biasing force of the gate roller 35*a* with respect to the feed roller 23*a* is reduced.

Figure 7:
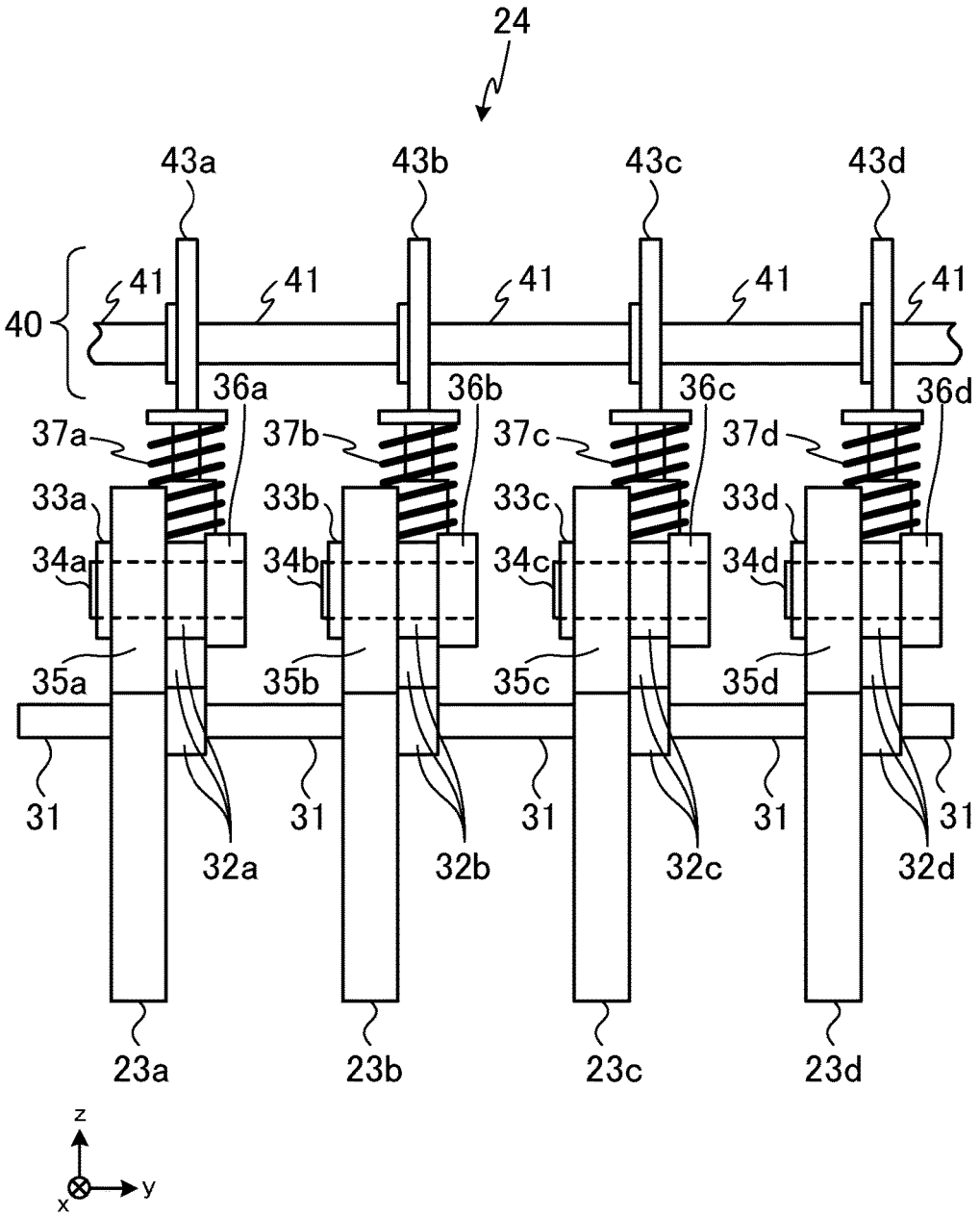
FIG. 7 illustrates the gate roller part illustrated in FIG. 5 as viewed in the −x-axis direction.

FIG. 7 illustrates the gate roller part 24 of FIG. 5 as viewed in the −x-axis direction. In FIG. 7, the components same as those of FIG. 4 and FIG. 5 are denoted with the same reference numerals. It is to be noted that, in FIG. 7, the shape of the gate roller part 24 and the like are schematically illustrated.

As illustrated in FIG. 7, the gate roller part 24 includes the arm shaft 31, the support arms 32*a* to 32*d*, the guide plates 33*a* to 33*d*, the gate roller shafts 34*a* to 34*d*, the gate rollers 35*a* to 35*d*, the shaft attaching members 36*a* to 36*d*, the biasing members 37*a* to 37*d*, and the cams 43*a* to 43*d*.

The configuration of the support arms 32*b* to 32*d* is similar to that of the support arm 32*a* described with FIG. 5. Each of the support arms 32*b* to 32*d* is rotatably and pivotally supported by the arm shaft 31 as with the support arm 32*a*. Each of the support arms 32*a* to 32*d* is pivotally supported by the arm shaft 31 in a separate and independent manner, and is thus separately and independently rotatable.

The configuration of the guide plates 33*b* to 33*d* is similar to that of the guide plate 33*a* described with FIG. 5. The guide plates 33*b* to 33*d* are respectively fixed to the support arms 32*b* to 32*d* as with the guide plate 33*a*.

The configuration of the gate roller shafts 34*b* to 34*d* is similar to that of the gate roller shaft 34*a* described with FIG. 5. Each of the gate roller shafts 34*a* to 34*d* is an individual and independent shaft. The gate roller shaft 34*b* extends through the gate roller 35*b* and the support arm 32*b*, and the both ends thereof are fixed to the guide plate 33*b* and the shaft attaching member 36*b*. The gate roller shaft 34*c* extends through the gate roller 35*c* and the support arm 32*c*, and the both ends thereof are fixed to the guide plate 33*c* and the shaft attaching member 36*c*. The gate roller shaft 34*d* extends through the gate roller 35*d* and the support arm 32*d*, and the both ends thereof are fixed to the guide plate 33*d* and the shaft attaching member 36*d*.

Each of the support arms 32*a* to 32*d* is an individual and independent member as described above. In addition, each of the gate roller shafts 34*a* to 34*d* is an individual and independent member as described above. Accordingly, the gate rollers 35*a* to 35*d* are capable of separately and independently moving along the circumference of a circle around the arm shaft 31, and separately and independently rotate around the gate roller shafts 34*a* to 34*d*, respectively.

The configuration of the biasing members 37*b* to 37*d* is similar to that of the biasing member 37*a* described with FIG. 5. One ends of the biasing members 37*b* to 37*d* are fixed to the respective support arms 32*b* to 32*d*, and the other ends thereof are in contact with the respective cams 43*b* to 43*d*.

The configuration of the cams 43*b* to 43*d* is similar to that of the cam 43*a* described with FIG. 5. The cams 43*b* to 43*d* are fixed to the adjusting shaft 41, and rotate along with the rotation of the adjusting shaft 41.

Figure 8:
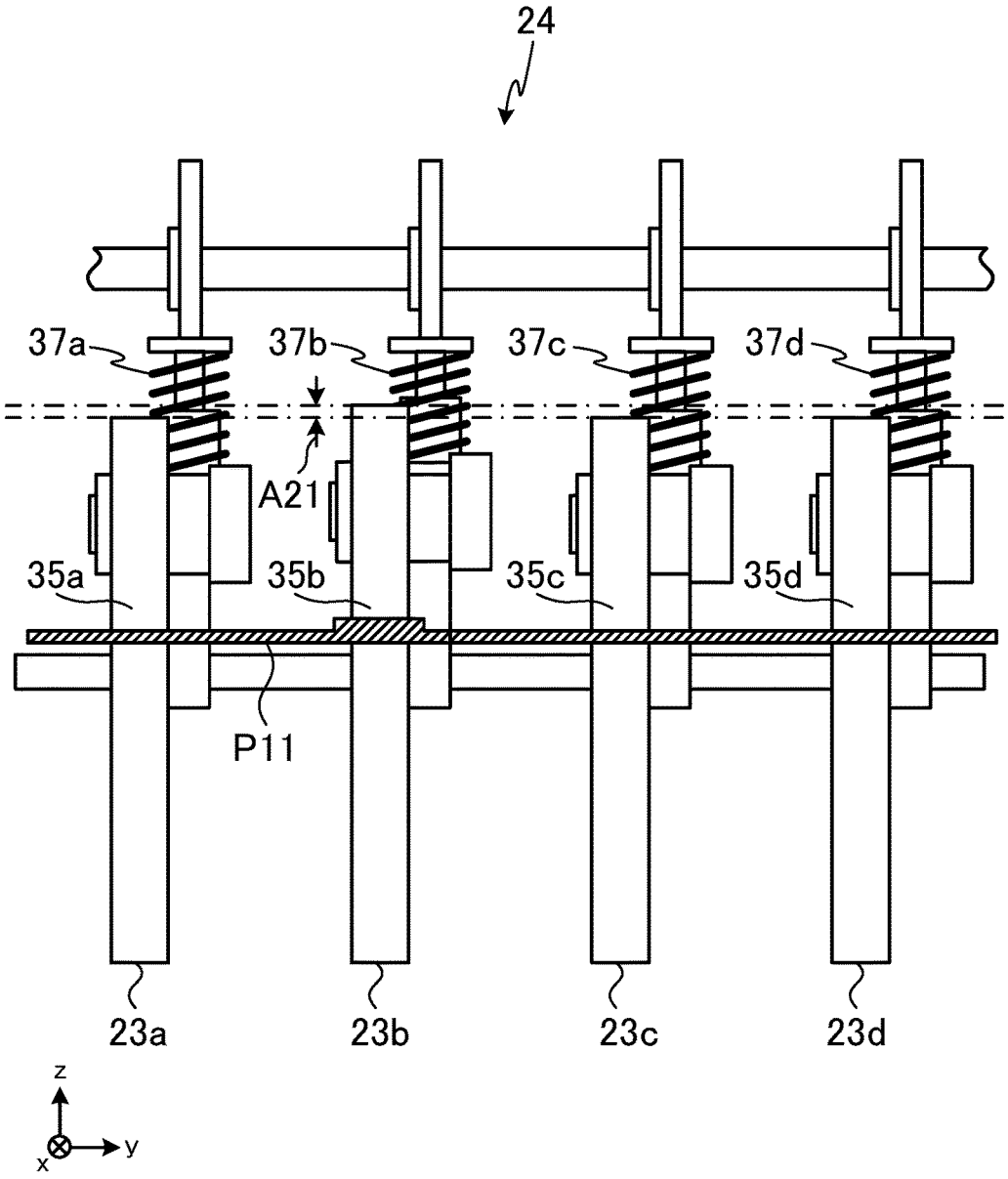
FIG. 8 illustrates a state where a banknote whose thickness varies depending on the portion passes through the gate roller part.

FIG. 8 illustrates a state where a banknote whose thickness varies depending on the portion passes through the gate roller part 24. In FIG. 8, the components same as those of FIG. 7 are denoted with the same reference numerals. FIG. 8 illustrates a banknote P11 passing between the feed rollers 23*a* to 23*d* and the gate rollers 35*a* to 35*d*.

The thickness of the banknote P11 is greater at the portion that passes between the feed roller 23*b* and the gate roller 35*b* than at other portions. In this case, the gate roller 35*b* moves upward with respect to the gate rollers 35*a*, 35*c* and 35*d* as arrow A21 indicates in FIG. 8.

In this manner, the gate rollers 35*a* to 35*d* can individually and independently move along the circumference of a circle around the arm shaft 31 (see, for example, two-headed arrow A11 in FIG. 6). With this configuration, even in the case where a banknote whose thickness varies depending on the portion passes therethrough, the gate roller part 24 can compensate the thickness variation of the banknote with the gate rollers 35*a* to 35*d* and can suppress skewing. In addition, also in the case where a banknote whose coefficient of friction varies depending on the portion passes therethrough, the gate roller part 24 can compensate the variation in coefficient of friction with the gate rollers 35*a* to 35*d* (for example, the frictional force can be reduced since any of the gate rollers 35*a* to 35*d* where a portion of a banknote which has a large coefficient of friction passes can move upward), and skewing can be suppressed.

Figure 9:
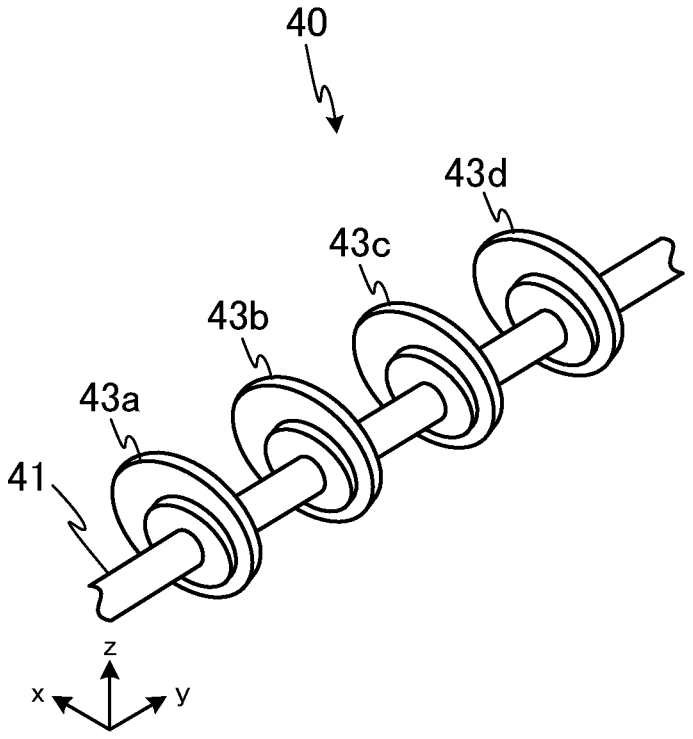
FIG. 9 is a perspective view of a part of an adjusting part.

FIG. 9 is a perspective view of a part of the adjusting part 40. In FIG. 9, the components same as those of FIG. 7 are denoted with the same reference numerals. In the following description, the spring constants of the coil springs of the biasing members 37*a* to 37*d* are equal to each other.

The cams 43*a* to 43*d* illustrated in FIG. 9 have the same shape, and are fixed to the adjusting shaft 41 such that the longitudinal axes thereof are oriented in the same direction. In the example illustrated in FIG. 9, the longitudinal axes of the cams 43*a* to 43*d* are oriented in the +x-axis direction.

When the adjusting shaft 41 having the above-mentioned the cams 43*a* to 43*d* are rotated, the biasing forces of the biasing members 37*a* to 37*d* are changed such that the values of the biasing forces are equal to each other.

Figure 10:
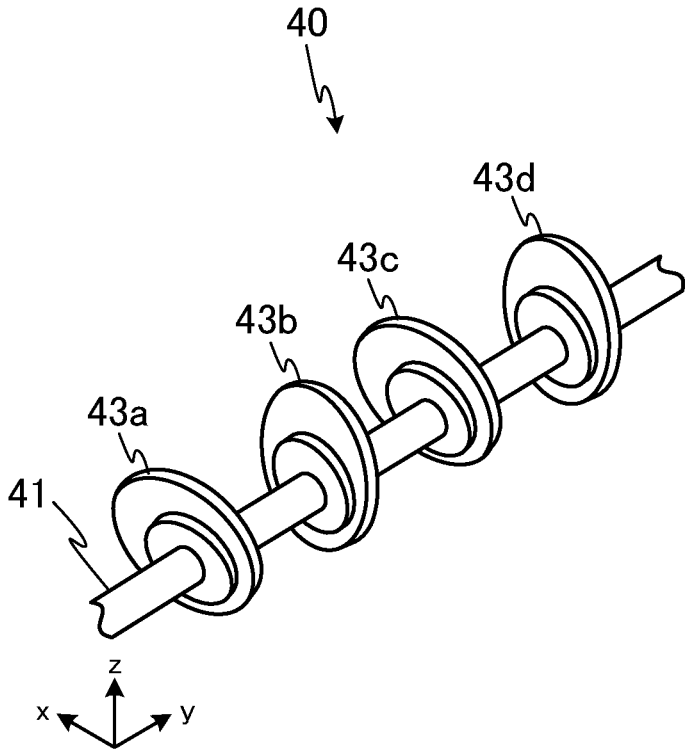
FIG. 10 is another perspective view of a part of the adjusting part.

FIG. 10 is another perspective view of a part of the adjusting part 40. In FIG. 10, the components same as those of FIG. 7 are denoted with the same reference numerals. In the following description, the spring constants of the coil springs of the biasing members 37*a* to 37*d* are equal to each other.

While the cams 43*a* to 43*d* illustrated in FIG. 10 have the same shape, the longitudinal axes thereof are fixed to the adjusting shaft 41 such that the longitudinal axes are oriented in different directions. In the example illustrated in FIG. 10, the longitudinal axes of the cams 43*a* and 43*c* are oriented in the +x-axis direction, while the longitudinal axes of the cams 43*b* and 43*d* are oriented in the +z-axis direction.

When the adjusting shaft 41 having the above-mentioned the cams 43*a* to 43*d* is rotated, the biasing forces of the biasing members 37*a* and 37*c* that make contact with the cams 43*a* and 43*c* are changed such that the biasing forces have the same values, and the biasing forces of the biasing members 37*b* and 37*d* that make contact with the cams 43*b* and 43*d* are changed such that the biasing forces have the same values. Then, the biasing forces of the biasing members 37*a* and 37*c* that make contact with the cams 43*a* and 43*c*, and the biasing force of the biasing members 37*b* and 37*d* that make contact with the cams 43*b* and 43*d* are different from each other.

It is to be noted that, the shapes of the cams 43*a* to 43*d* may be different from each other. With this configuration, the adjusting part 40 can change the biasing forces of the biasing members 37*a* to 37*d* such that the biasing forces have different values.

In addition, coil springs of different spring constants may be applied to the biasing members 37*a* to 37*d*. With this configuration, even in the case where the cams 43*a* to 43*d* having the same shape are fixed to the adjusting shaft 41 so as to be oriented in the same direction as illustrated in FIG. 9, the adjusting part 40 can change the biasing forces of the biasing members 37*a* to 37*d* such that the biasing forces have different values.

In addition, the cams 43*a* to 43*d* may be respectively fixed to individual and independent adjusting shafts. Then, an adjusting knob may be provided to the individual and independent adjusting shaft. With this configuration, the adjusting part 40 can individually adjust the values of the biasing forces of the biasing members 37*a* to 37*d*.

In addition, it is possible to adopt a configuration in which, by setting the denomination of the banknote to be fed from the placing part 2 in the operation part 6, the adjusting shaft 41 is automatically turned, and the values of the biasing forces of the biasing members 37*a* to 37*d* are adjusted.

As described above, paper sheet feeding unit 11 includes a plurality of feed rollers 23*a* to 23*d*, and a plurality of gate rollers 35*a* to 35*d* disposed opposite to respective feed rollers 23*a* to 23*d* in a one-to-one relationship. In addition, paper sheet feeding unit 11 includes biasing members 37*a* to 37*d* that bias gate rollers 35*a* to 35*d* individually in a direction of feed rollers 23*a* to 23*d*, and support arms 32*a* to 32*d* that support gate rollers 35*a* to 35*d* and biasing members 37*a* to 37*d*.

With this configuration, even in the case where a banknote whose thickness varies depending on the portion passes through the paper sheet feeding unit 11, the gate rollers 35*a* to 35*d* move to compensate the thickness variation of the banknote, by being biased independently respectively, and thus skewing is suppressed. In addition, even in the case where a banknote having a uniform thickness whose coefficient of friction varies depending on the portion passes through paper sheet feeding unit 11, the gate rollers 35*a* to 35*d* move to compensate the variation in coefficient of friction of the banknote, by being biased independently respectively, and thus skewing is suppressed.

While banknotes whose thickness and/or coefficient of friction varies such as hybrid banknotes in which a partially transparent polymer part is formed, and banknotes provided with a security thread for counterfeiting prevention are in circulation in recent years, skewing of such banknotes can also be suppressed, and removal of the security thread can be suppressed, for example.

In addition, the paper sheet feeding unit 11 includes the adjusting part 40 that adjusts the biasing forces of the biasing members 37*a* to 37*d*. With this configuration, the paper sheet feeding unit 11 can handle banknotes of various thicknesses.

Second Embodiment

The biasing member is provided for each gate roller in the first embodiment. In the second embodiment, gate rollers are grouped into a plurality of groups, and the biasing member is provided for each group.

Figure 11:
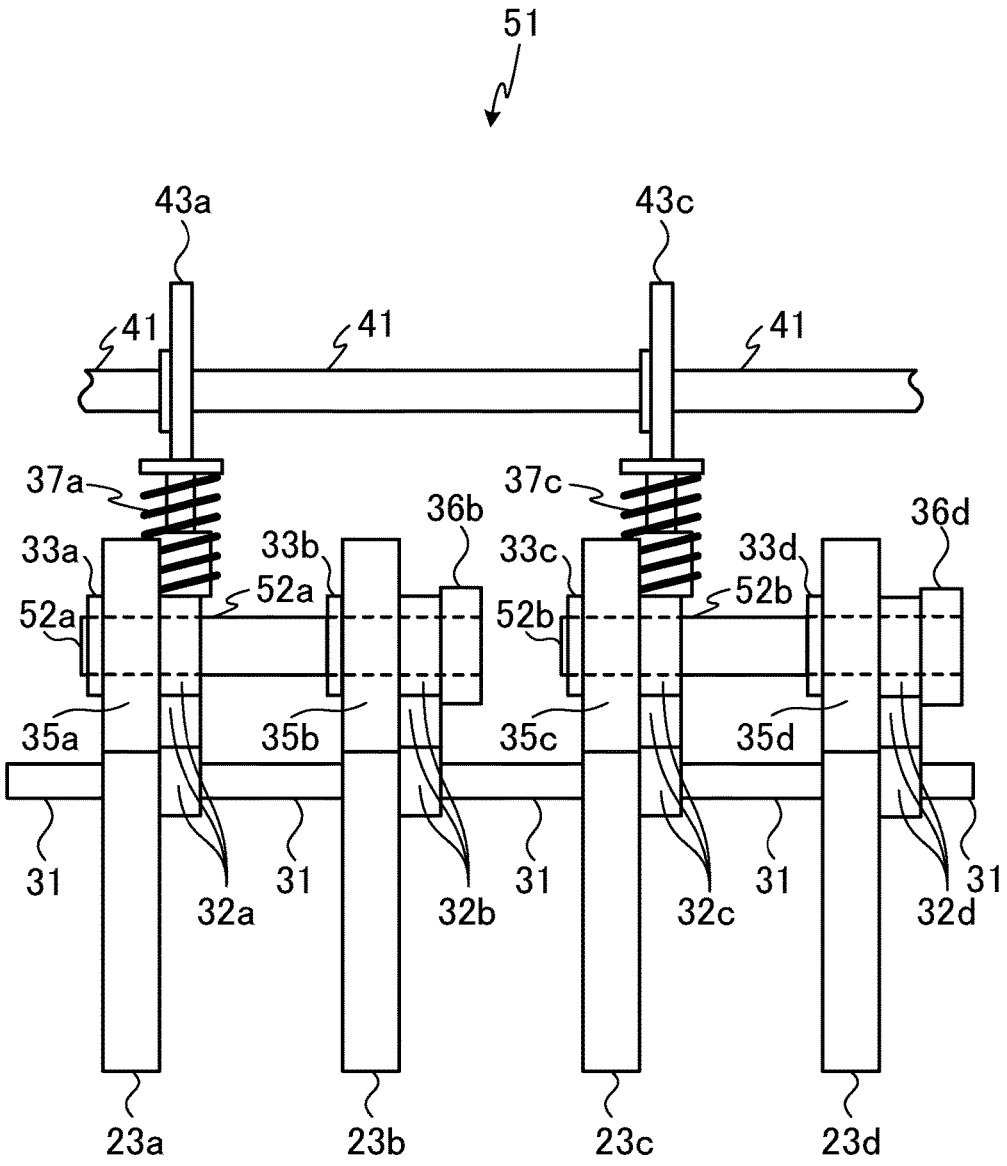
FIG. 11 illustrates a paper sheet feeding unit according to a second embodiment of the present invention.

FIG. 11 illustrates a gate roller part 51 of the paper sheet feeding unit 11 according to the second embodiment of the present invention. In FIG. 11, the components same as those of FIG. 7 are denoted with the same reference numerals. As illustrated in FIG. 11, the gate roller part 51 includes gate roller shafts 52*a* and 52*b*.

In the gate roller part 51 illustrated in FIG. 11, the biasing member 37*a* is provided for the two gate rollers 35*a* and 35*b*. In addition, in the gate roller part 51, the biasing member 37*c* is provided for the two gate rollers 35*c* and 35*d*. That is, in the gate roller part 51 illustrated in FIG. 11, a plurality of gate rollers 35*a* to 35*d* are grouped into a plurality of groups, and the biasing members 37*a* and 37*c* are provided to respective groups.

One end of the gate roller shaft 52*a* is fixed to the guide plate 33*a*, and the other end thereof is fixed to the shaft attaching member 36*b*. The gate roller shaft 52*a* extends through the gate roller 35*a*, the support arm 32*a*, the guide plate 33*b*, the gate roller 35*b*, and the support arm 32*b*. The gate rollers 35*a* and 35*b* have a common the gate roller shaft 52*a*, and therefore move together along the circumference of a circle around the arm shaft 31. In addition, the gate rollers 35*a* and 35*b* rotate around the gate roller shaft 52*a*.

One end of the biasing member 37*a* is fixed to the support arm 32*a*, and the other end thereof is in contact with the cam 43*a*. The biasing member 37*a* alone biases the two gate rollers 35*a* and 35*b* in a direction of the feed rollers 23*a* and 23*b*. It is to be noted that the biasing member is not fixed to the support arm 32*b*.

One end of the gate roller shaft 52*b* is fixed to the guide plate 33*c*, and the other end thereof is fixed to the shaft attaching member 36*d*. The gate roller shaft 52*b* extends through the gate roller 35*c*, the support arm 32*c*, the guide plate 33*d*, the gate roller 35*d*, and the support arm 32*d*. The gate rollers 35*c* and 35*d* have common the gate roller shaft 52*b*, and therefore move together along the circumference of a circle around the arm shaft 31. In addition, the gate rollers 35*c* and 35*d* rotate around the gate roller shaft 52*b*.

One end of the biasing member 37*c* is fixed to the support arm 32*c*, and the other end thereof is in contact with the cam 43*c*. The biasing member 37*c* alone biases the two gate rollers 35*c* and 35*d* in a direction of the feed rollers 23*c* and 23*d*. It is to be noted that the biasing member is not fixed to the support arm 32*d*.

As described above, the plurality of gate rollers 35*a* to 35*d* are grouped into a plurality of groups, and the biasing members 37*a* and 37*c* are provided for respective groups. With this configuration, the paper sheet feeding unit 11 can reduce the number of components such as the biasing member, and can achieve cost reduction.

While adjacent the gate rollers 35*a* and 35*b* are grouped, and adjacent the gate rollers 35*c* and 35*d* are grouped in the above-mentioned configuration, the way of grouping is not limited to this. For example, it is also possible to group the gate rollers 35*a* and 35*d*, and group the gate rollers 35*b* and 35*c*. In addition, for example, it is also possible to group the gate rollers 35*a* and 35*c*, and group the gate rollers 35*b* and 35*d*. Further, it is also possible to group the gate rollers 35*a*, 35*b*, and 35*c*, while separating the gate roller 35*d*.

The grouping of the gate rollers 35*a* to 35*d* is determined based on the thickness of the banknote, for example. For example, in the gate rollers 35*a* to 35*d*, the gate rollers where a portion of the same thickness, of a banknote, passes are grouped. In addition, for example, the grouping is determined based on the coefficient of friction of the banknote. For example, in the gate rollers 35*a* to 35*d*, the gate rollers where a portion of the same coefficient of friction, of a banknote, passes are grouped.

REFERENCE SIGNS LIST

1 Paper sheet processing device
2 Placing part
3*a* to 3*d*, 4*a*, 4*b* Storing part
5 Display part
6 Operation part
11 Paper sheet feeding unit
23*a* to 23*d* Feed roller
24, 51 Gate roller part
31 Arm shaft
32*a* to 32*d* Support arm
33*a* to 33*d* Guide plate
34*a* to 34*d* Gate roller shaft
35*a* to 35*d* Gate roller
36*a* to 36*d* Shaft attaching member
37*a* to 37*d* Biasing member
41 Adjusting shaft
42 Adjusting knob
43*a* to 43*d* Cam

The invention claimed is:

1. A sheet processing apparatus, comprising:
a placing unit configured to place a sheet;
a sheet feeding unit disposed at the placing unit, the sheet feeding unit including a plurality of roller units, and configured to feed the sheet placed on the placing unit one by one into the apparatus; and
a conveyance unit configured to convey, one by one, the sheet fed into the apparatus by the sheet feeding unit,
wherein each of the plurality of roller units of the sheet feeding unit comprises:
a feed roller;
a gate roller disposed opposite to the feed roller;
a biasing member configured to bias the gate roller in a direction of the feed roller;
a supporting member configured to support the gate roller and the biasing member of the each of the plurality of roller units; and
an adjusting part configured to adjust a biasing force of the biasing member,
wherein, when the sheet feeding unit feeds the sheet whose thickness varies depending on a portion of the sheet into the apparatus and the sheet passes between the feed roller and the gate roller, a gate roller of one of the plurality of roller units moves independently from a gate roller of other one of the plurality of roller units to compensate for the variation in thickness of the sheet, and wherein the biasing member of each of the plurality of roller units includes a first edge part fixed to the supporting member and a second edge part in contact with the adjusting part, and a first adjusting part of one of the plurality of roller units adjusts the biasing force of the biasing member independently from a second adjusting part of other one of the plurality of roller units.

2. The sheet processing apparatus according to claim 1, wherein:

the adjusting part of each of the plurality of roller units comprises a cam and an adjusting shaft provided with the cam; and the biasing force of the biasing member of each of the plurality of roller units is capable of being adjusted by rotation of the cam around an rotation axis of the adjusting shaft.

3. The sheet processing apparatus according to claim 1, wherein:

the supporting member comprises a plurality of supporting members respectively included in each of the plurality of roller units, and each supporting member is pivotally supported by a support arm shaft and rotatable independently from other one of the plurality of supporting members included in the plurality of roller units.

4. The sheet processing apparatus according to claim 1, wherein each gate roller of the plurality of roller units rotates around an independent gate roller shaft.

5. The sheet processing apparatus according to claim 1, further comprising:

an identification unit configured to identify, one by one, the sheet conveyed by the conveyance unit; and a storing unit configured to store the sheet identified by the identification unit.

* * * * *